US005979558A

United States Patent [19]

Bouldin et al.

[11] Patent Number: 5,979,558

[45] **Date of Patent: *Nov. 9, 1999**

[54] VARIABLE CHOKE FOR USE IN A SUBTERRANEAN WELL

[76] Inventors: Brett Wayne Bouldin, 707 Creek Forest Cir., Spring, Tex. 77380; Napoleon Arizmendi, 11910W. Presley, Magnolia, Tex. 77355

[ * ] Notice: This patent issued on a continued prosecution application filed under 37 CFR 1.53(d), and is subject to the twenty year patent term provisions of 35 U.S.C. 154(a)(2).

[21] Appl. No.: 08/898,567

[22] Filed: Jul. 21, 1997

[51] Int. Cl.[6] ..... E21B 34/06

[52] U.S. Cl. ..... 166/363; 166/373; 166/334.4

[58] Field of Search ..... 166/363, 373, 166/364, 332.1, 334.1, 334.4

[56] References Cited

U.S. PATENT DOCUMENTS

| | | | |
|---|---|---|---|
| 1,747,910 | 2/1930 | Siefarth . | |
| 2,178,540 | 11/1939 | McNeese et al. . | |
| 3,821,962 | 7/1974 | Mott . | |
| 4,062,406 | 12/1977 | Akkerman et al. . | |
| 4,162,691 | 7/1979 | Perkins . | |
| 4,252,143 | 2/1981 | Fredd . | |
| 4,569,370 | 2/1986 | Witt | 137/625.3 |
| 4,633,952 | 1/1987 | Ringgenberg . | |
| 4,848,472 | 7/1989 | Hopper | 166/339 X |
| 4,896,722 | 1/1990 | Upchurch | 166/53 X |
| 5,176,220 | 1/1993 | Akkerman . | |
| 5,211,241 | 5/1993 | Mashaw, Jr. et al. . | |
| 5,316,084 | 5/1994 | Murray et al. | 166/332 |
| 5,431,188 | 7/1995 | Cove | 137/625.3 |

FOREIGN PATENT DOCUMENTS 2159194 11/1985 United Kingdom .

OTHER PUBLICATIONS

Search Report for Application PCT/GB98/02242.
Master Flow Valve, Inc. catalog, undated.

*Primary Examiner*—Roger Schoeppel
*Attorney, Agent, or Firm*—Marlin R. Smith

[57] ABSTRACT

A flow control apparatus and associated methods of using provide enhanced longevity and reliability without requiring complex mechanisms. In a described embodiment, a choke for use within a subterranean well has a choke member set which may be opened by manipulation of an inner tubular cage. The inner cage is displaced from within an outer sleeve, which restricts fluid flow through ports formed through a sidewall portion of the inner cage. As the inner cage is progressively withdrawn from within the sleeve, the fluid flow through the ports is decreasingly restricted by the sleeve.

58 Claims, 5 Drawing Sheets

FIG.5A
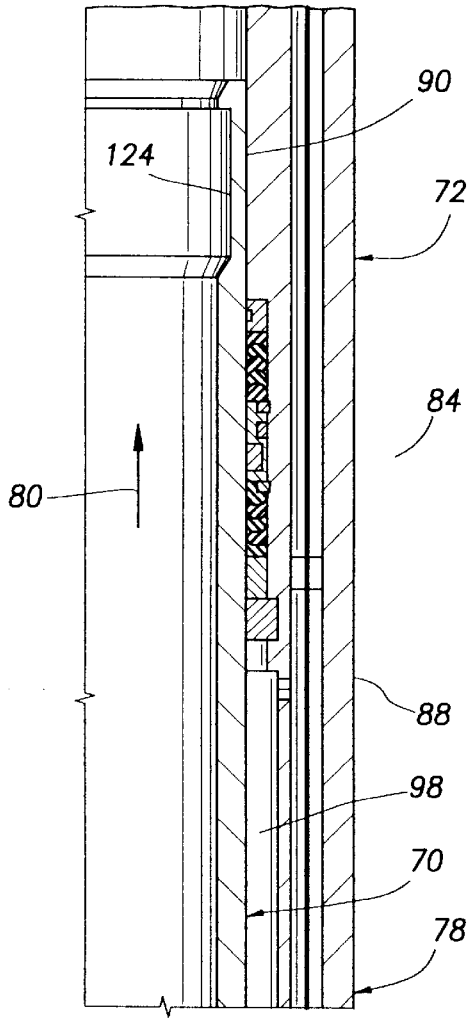
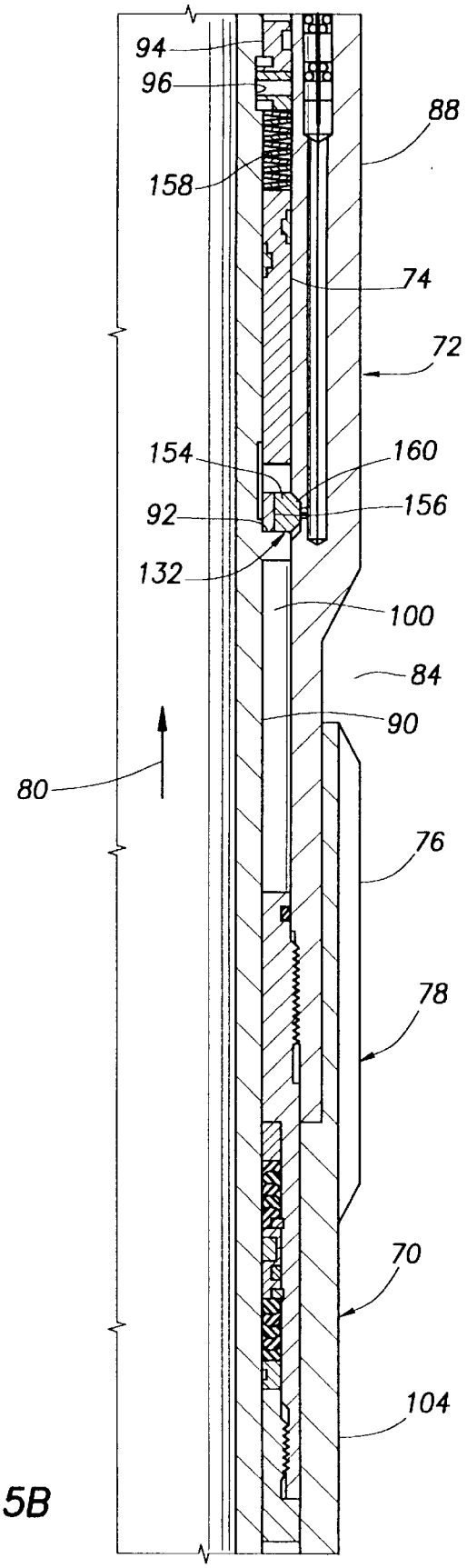
FIG.5B

FIG.5C
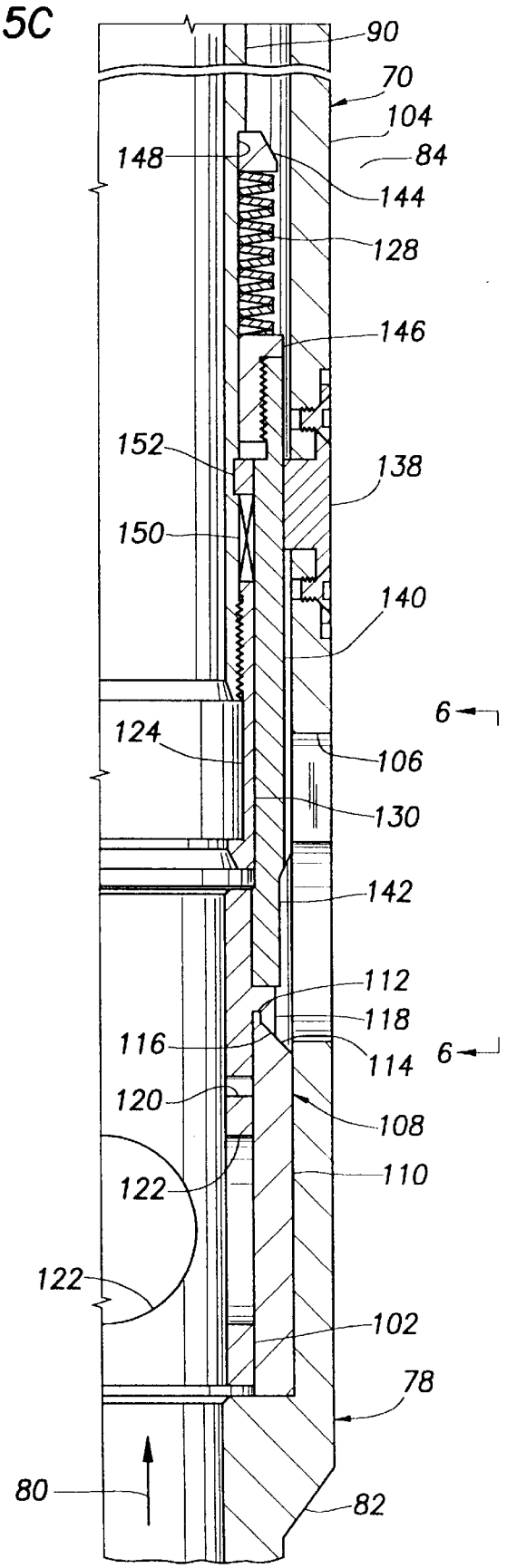
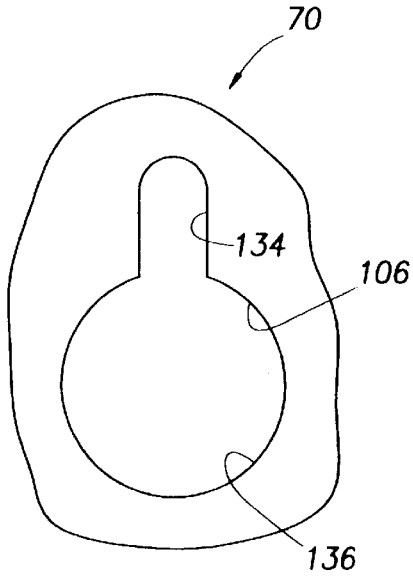
FIG.6

VARIABLE CHOKE FOR USE IN A SUBTERRANEAN WELL

CROSS-REFERENCE TO RELATED APPLICATIONS

This application is related to a copending application filed on even date herewith, entitled FLOW CONTROl APPARATUS having Mark A. Schnatzmcyer as an inventor thereof and an attorney docket number of 970332 U1 USA (application Ser. No. 08/898,504, filed Jul. 21, 1997). The disclosure of the copending application is incorporated herein by this reference.

BACKGROUND OF THE INVENTION

The present invention relates generally to apparatus utilized to control fluid flow in a subterranean well and, in an embodiment described herein, more particularly provides a choke for selectively regulating fluid flow into or out of a tubing string disposed within a well.

In a subsea well completion it is common for the well to be produced without having a rig or production platform on site. In this situation, it is well known that any problems that occur with equipment or other aspects of the completion may require a rig to be moved on site, in order to resolve the problem. Such operations are typically very expensive and should be avoided if possible.

An item of equipment needed, particularly in subsea completions, is a flow control apparatus which is used to throttle or choke fluid flow into a production tubing string. The apparatus would be particularly useful where multiple zones are produced and it is desired to regulate the rate of fluid flow into the tubing string from each zone. Additionally, regulatory authorities may require that rates of production from each zone be reported, necessitating the use of the apparatus or other methods of determining and/or controlling the rate of production from each zone. Safety concerns may also dictate controlling the rate of production from each zone.

Such an item of equipment would also be useful in single zone completions. For example, in a single wellbore producing from a single zone, an operator may determine that it is desirable to reduce the flow rate from the zone into the wellbore to limit damage to the well, reduce water coning and/or enhance ultimate recovery.

Downhole valves, such as sliding side doors, are designed for operation in a fully closed or fully open configuration and, thus, are not useful for variably regulating fluid flow therethrough. Downhole chokes typically are provided with a fixed orifice which cannot be closed. These are placed downhole to limit flow from a certain formation or wellbore. Unfortunately, conventional downhole valves and chokes are also limited in their usefulness because intervention is required to change the fixed orifice or to open or close the valve.

What is needed is a flow control apparatus which is rugged, reliable, and long-lived, so that it may be utilized in completions without requiring frequent service, repair or replacement. To compensate for changing conditions, the apparatus should be adjustable without requiring slickline, wireline or other operations which need a rig for their performance, or which require additional equipment to be installed in the well. The apparatus should be resistant to erosion, even when it is configured between its fully open and closed positions, and should be capable of accurately regulating fluid flow.

Such a downhole variable choking device would allow an operator to maximize reservoir production into the wellbore. It would be useful in surface, as well as subsea, completions, including any well where it is desired to control fluid flow, such as gas wells, oil wells, and water and chemical injection wells. In sum, in any downhole environment for controlling flow of fluids.

It is accordingly an object of the present invention to provide such a flow control apparatus which permits variable downhole flow choking as well as the ability to shut off fluid flow, and associated methods of controlling fluid flow within a subterranean well.

SUMMARY OF THE INVENTION

In carrying out the principles of the present invention, in accordance with an embodiment thereof, an apparatus is provided which is a choke for use within a subterranean well. The described choke provides ruggedness, simplicity, reliability and longevity in regulating fluid flow into or out of a tubing string within the well.

In broad terms, a choke is provided which includes a tubular inner cage, an outer housing and a choke member set. The cage is slidingly disposed within the housing and the choke member set is carried externally on the cage. Manipulation of the cage by a conventional actuator or shifting tool causes the choke member set to partially open, fully open, and close as desired.

The choke member set utilizes a design which both impedes erosion and wear of the choke components, and, in combination with the cage, permits commingling of fluids produced from multiple zones of the well, or control of fluids injected into multiple zones. Commingling of fluids produced, or control of fluids injected, may be precisely regulated by manipulation of the cage with the actuator.

These and other aspects, features, objects, and advantages of the present invention will be more fully appreciated following careful consideration of the detailed description and accompanying drawings set forth hereinbelow.

BRIEF DESCRIPTION OF THE DRAWINGS

FIGS. 5A–5C are quarter-sectional views of successive axial portions of another choke embodying principles of the present invention, the choke being shown in a configuration in which it is initially run into a subterranean well attached to an actuator and interconnected in a production tubing string; and FIG. 6 is an elevational view of an opening formed through an outer housing of the choke of FIGS. 5A–5C, as indicated by arrows 6—6.

DETAILED DESCRIPTION

Figure 1A:
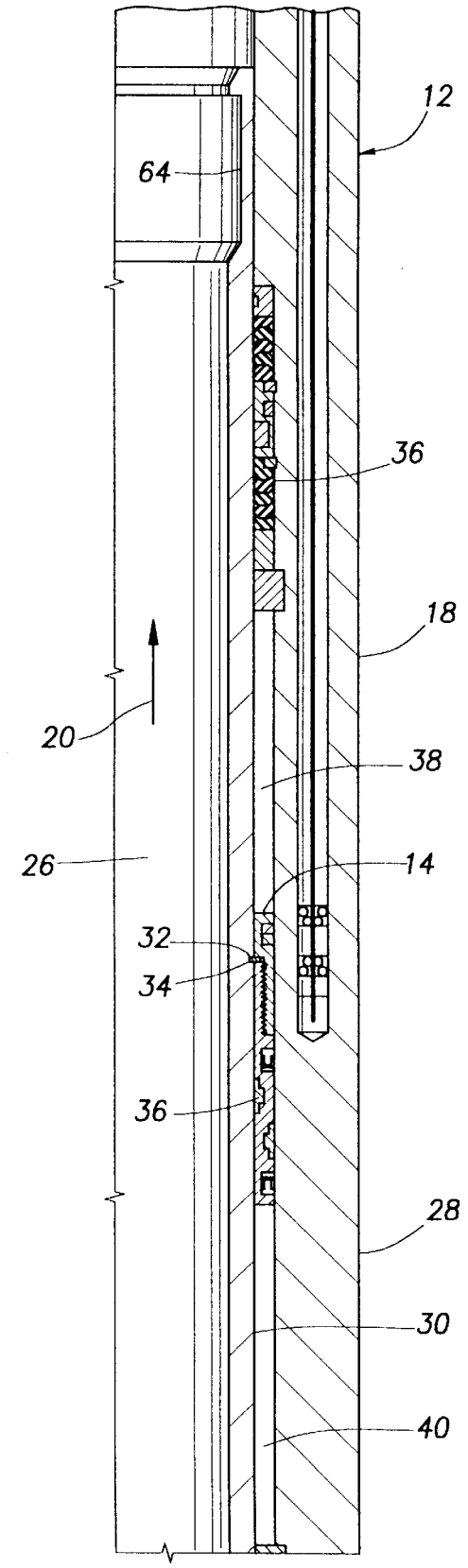
FIGS. 1A–1B are quarter-sectional views of successive axial portions of a choke embodying principles of the present invention, the choke being shown in a configuration in which it is initially run into a subterranean well attached to an actuator and interconnected in a production tubing string.
Figure 1B:
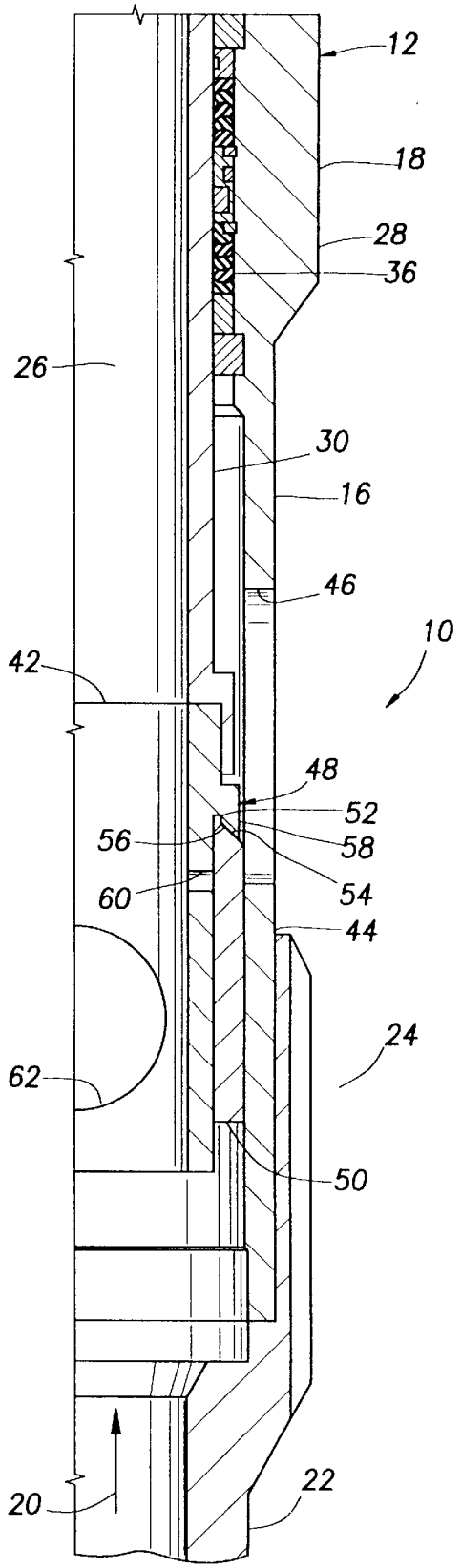

Representatively illustrated in FIGS. 1A–1B is a choke 10 which embodies principles of the present invention. In the following description of the choke 10 and other apparatus and methods described herein, directional terms, such as "above", "below", "upper", "lower", etc., are used for convenience in referring to the accompanying drawings. Although the choke 10 and other apparatus, etc., shown in the accompanying drawings are depicted in successive axial sections, it is to be understood that the sections form a continuous assembly. Additionally, it is to be understood that the various embodiments of the present invention described herein may be utilized in various orientations, such as inclined, inverted, horizontal, vertical, etc., without departing from the principles of the present invention.

The choke 10 is sealingly attached to an actuator 12, a lower portion of which is shown in FIG. 1A. In a manner which will be more fully described hereinbelow, the actuator 12 is used to operate the choke 10. The actuator 12 may be hydraulically, electrically, mechanically, magnetically or otherwise controlled without departing from the principles of the present invention. The representatively illustrated actuator 12 is a SCRAMS ICV hydraulically controlled actuator manufactured by, and available from, PES, Incorporated of The Woodlands, Texas. It includes an actuator member or annular piston 14 which is axially displaceable relative to the choke 10 by appropriate hydraulic pressure applied to the actuator 12 via control lines (not shown) extending to the earth's surface.

In a method of using the choke 10, the choke and actuator 12 are positioned within a subterranean well as part of a production tubing string 18 extending to the earth's surface. As representatively illustrated in FIGS. 1A–1B, fluid (indicated by arrows 20) may flow axially through the choke 10 and actuator 12, and to the earth's surface via the tubing string 18. The fluid 20 may, for example, be produced from a zone of the well below the choke 10. In that case, an additional portion of the tubing string 18 including a packer (not shown) would be attached in a conventional manner to a lower adaptor 22 of the choke 10 and set in the well in order to isolate the zone below the choke from other zones of the well, such as a zone in fluid communication with an area 24 surrounding the choke.

In a manner more fully described hereinbelow, the choke 10 enables accurate regulation of fluid flow between the external area 24 and an internal axial fluid passage 26 extending through the choke. In another method of using the choke 10, multiple chokes may be installed in the tubing string 18, with each of the chokes corresponding to a respective one of multiple zones intersected by the well, and with the zones being isolated from each other external to the tubing string. Thus, the choke 10 also enables accurate regulation of a rate of fluid flow from each of the multiple zones, with the fluids being commingled in the tubing string 18.

It is to be understood that, although the tubing string 18 is representatively illustrated in the accompanying drawings with fluid 20 entering the lower adaptor 22 and flowing upwardly through the fluid passage 26, the lower connector 22 may actually be closed off or otherwise isolated from such fluid flow in a conventional manner, such as by attaching a bull plug thereto, or the fluid 20 may be flowed downwardly through the fluid passage 26, for example, in order to inject the fluid into a formation intersected by the well, without departing from the principles of the present invention. For convenience and clarity of description, the choke 10 and associated tubing string 18 will be described hereinbelow as it may be used in a method of producing fluids from multiple zones of the well, the fluids being commingled within the tubing string, and it being expressly understood that the choke 10 may be used in other methods without departing from the principles of the present invention.

An upper portion 16 of the choke 10 is attached to the actuator 12. As shown in FIG. 1B, the upper portion 16 is integrally formed with an outer housing 28 of the actuator 12. However, it is to be understood that the choke 10 may be threadedly attached to the actuator 12, or otherwise attached thereto without departing from the principles of the present invention. In that manner, the choke 10 may be used with other actuators, attached directly to the remainder of the tubing string 18, etc.

The piston 14 is attached externally about an upper generally tubular operating mandrel 30 of the choke 10. A retaining ring 32 extends radially inwardly from the piston 14 and engages an annular groove 34 formed externally on the mandrel 30. Thus, axial displacement of the piston 14 by the actuator 12 will cause a corresponding axial displacement of the mandrel 30.

The mandrel 30 is axially reciprocably and sealingly received in the actuator 12. Circumferential seals 36 sealingly engage the mandrel 30 externally and permit fluid isolation between two chambers 38, 40. In this manner, it may be considered that the mandrel 30 becomes a part of the actuator 12, but it is to be clearly understood that it is not necessary, in keeping with the principles of the present invention, for the mandrel 30 to form a part of the actuator 12.

To operate the choke 10, the mandrel 30 is axially displaced relative to the upper portion 16, in order to axially displace an inner axially extending and generally tubular cage member 42 relative to an outer housing 44 of the choke. The mandrel 30 is sealingly interconnected to the cage 42 by shrink fitting it thereto, although any other suitable connection method, such as brazing, threading, integrally forming, etc., may be utilized without departing from the principles of the present invention. The applicants use shrink fitting since, in the representatively illustrated embodiment of the invention, the cage 42 is made of a highly erosion resistant material, such as carbide, while the mandrel 30 is made of an alloy steel.

Axial displacement of the mandrel 30 is accomplished by applying fluid pressure to one of the chambers 38, 40 to thereby apply an axially directed biasing force to the piston 14. For example, if it is desired to displace the mandrel 30 axially upward to permit fluid flow through the choke 10 or to decrease resistance to fluid flow therethrough, fluid pressure may be applied to the lower chamber 40. Conversely, if it is desired to downwardly displace the mandrel 30 to prevent fluid flow through the choke 10 or to increase resistance to fluid flow therethrough, fluid pressure may be applied to the upper chamber 38.

The housing 44 includes a series of axially elongated and circumferentially spaced apart openings 46, only one of which is visible in FIG. 1B. The openings 46 are formed through a sidewall portion of the housing 44 and thereby provide fluid communication between the area 24 external to the choke 10 and the interior of the housing. The housing 44 is integrally formed with the upper portion 16, and is threadedly and sealingly attached to the lower adaptor 22, with the openings 46 being positioned axially between the upper portion 16 and the lower adaptor.

A choke member set 48 is disposed within the outer housing 44 and includes a portion of a sleeve 50 received sealingly within the outer housing. As used herein, the term "choke member set" is used to describe an element or combination of elements which perform a function of regulating fluid flow. In the illustrated embodiment of the invention, the choke member set 48 includes an upper portion of the sleeve 50 and portions of the cage 42, which will be more fully described hereinbelow. The applicants prefer that the choke member set 48 be configured in some respects similar to those utilized in a Master Flo Flow Trim manufactured by, and available from, Master Flo of Ontario, Canada, although other choke member sets may be utilized without departing from the principles of the present invention.

The sleeve 50 is sealingly received in the housing 44 by shrink fitting it therein. Of course, other methods of sealingly attaching the sleeve 50 may be utilized without departing from the principles of the present invention. For example, the sleeve 50 could be threaded into the housing 44, brazed therein, etc.

The sleeve 50 includes an axially extending and internally inclined lip 52 adjacent an externally inclined seal surface 54. The lip 52 acts to prevent, or at least greatly reduce, erosion of the seal surface 54, among other benefits. The seal surface 54 is cooperatively shaped to sealingly engage a seal surface 56 internally formed on a seat 58, which is externally carried on the cage 42 and integrally formed therewith. In the configuration of the choke 10 shown in FIG. 1B, the seal surface 54 is contacting and sealingly engaging the seal surface 56. Preferably, the seal surfaces 54, 56 are formed of hardened metal or carbide for erosion resistance, although other materials may be utilized without departing from the principles of the present invention. Additionally, the seat 58, which includes the seal surface 56, may be wholly or partially formed of hardened metal or carbide, and may be separately formed from the cage 42.

The cage 42 has a set of flow ports 60, and a set of comparatively larger flow ports 62, formed radially therethrough. Each of the sets of ports 60, 62 includes two circumferentially spaced apart and oppositely disposed ports, although only one of each is visible in FIG. 1B. Of course, other numbers of ports may be utilized in the flow port sets 60, 62 without departing from the principles of the present invention. In the configuration of the choke 10 shown in FIG. 1B, the upper ports 60 and lower ports 62 are radially outwardly overlaid by the sleeve 50, and the seal surfaces 54, 56 are sealingly engaged. Tus, fluid communication between the external area 24 and the flow passage 26 through the flow ports 60, 62 is prevented by the sleeve 50.

As representatively illustrated in the accompanying drawings, the flow ports 60 are comparatively small, in order to provide an initial relatively highly restricted fluid flow therethrough when the cage 42 is displaced axially upward to permit fluid flow between the seal surfaces 54, 56, as more fully described hereinbelow. However, it is to be understood that the flow ports 60 may be otherwise dimensioned, otherwise positioned, otherwise dimensioned with respect to each other, and otherwise positioned with respect to each other, without departing from the principles of the present invention. For example, the upper flow ports 60 may actually have larger or smaller diameters, may have larger or smaller diameters than the lower flow ports 62, may be positioned differently on the cage 42, and may be positioned differently with respect to the lower flow ports. Similar changes may be made to the lower flow ports 62. Indeed, it is not necessary for the cage 42 to have differently configured sets of flow ports 60, 62 at all. Thus, the flow port sets 60, 62 shown in the accompanying drawings are merely illustrative and additions, modifications, deletions, substitutions, etc., may be made thereto without departing from the principles of the present invention.

As shown in FIG. 1B, the cage 42 is prevented from displacing axially downward relative to the sleeve 50 by axial contact between the seal surfaces 54, 56. Such axial contact may be maintained by maintaining fluid pressure in the chamber 38 of the actuator 12. It will be readily apparent to a person of ordinary skill in the art that such axial contact may also be maintained by provision of a biasing member (not shown), which applies an axially downward biasing force to the mandrel 30 or cage 42. For example, a compression spring may be installed in the chamber 38 to apply a downwardly directed biasing force to the piston 14 and, therefore, to the mandrel 30. However, applicants prefer that the cage 42 not be biased into axial contact with the sleeve 50, so that the choke 10 may be opened and remain open in the event that a failure should be experienced in the actuator 12. For displacement of the mandrel 30 and cage 42 in the event of such a failure, a conventional shifting profile 64 is internally formed on the mandrel 30, which may be engaged by a shifting tool (not shown) conveyed on wireline, slickline, coiled tubing, etc., in a conventional manner. Of course, other profiles and methods of displacing the mandrel 30 and/or cage 42 may be utilized without departing from the principles of the present invention. Additionally, other methods of maintaining the cage 42 in a desired position relative to the housing 44 may be utilized without departing from the principles of the present invention. For example, detents, etc., may be configured to cooperatively engage the cage 42 and/or housing 44.

If the cage 42 is displaced axially upward relative to the sleeve 50 and housing 44, the seal surfaces 54, 56 will disengage and fluid flow will be permitted between the external area 24 and the fluid passage 26. Thus, the choke member set 48 is selectively openable by axially displacing the cage 42 upward from its position shown in FIG. 1B. The choke member set 48 may be maintained in an open position by, for example, a latching device (not shown).

Figure 2:
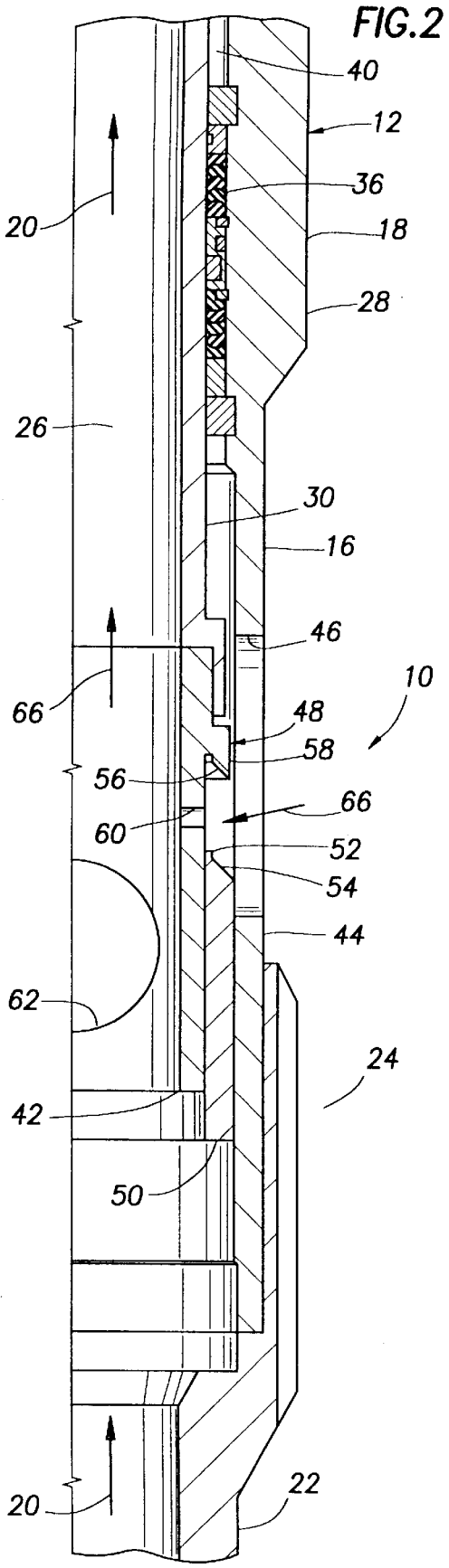
FIG. 2 is a quarter-sectional view of an axial portion of the choke of FIGS. 1A–1B, the choke being shown in a configuration in which a choke member set has been partially opened.

Referring additionally now to FIG. 2, an axial portion of the choke 10 is representatively illustrated in a configuration in which the upper flow ports 60 are exposed to direct fluid flow between the area 24 and the fluid passage 26. In this configuration, the cage 42 has been axially upwardly displaced relative to the housing 44 and sleeve 50. The seal surfaces 54, 56 are no longer sealingly engaged, thus permitting fluid communication between the area 24 and the fluid passage 26.

It will be readily apparent to a person of ordinary skill in the art that, with suitable modification, e.g., interchanging the cage 42 and sleeve 50, the sleeve may instead be displaced relative to the cage, to permit fluid communication between the area 24 and the fluid passage 26. Alternatively, both the cage 42 and sleeve 50 could be displaced relative to the housing 44 and to each other. No matter the manner in which relative displacement occurs between the cage 42 and sleeve 50, such relative displacement permits variable choking of fluid flow through the flow ports 60, 62 and sealing engagement between the seal surfaces 54, 56 when desired.

The sleeve 50 is preferably closely fitted externally about the cage 42. Thus, fluid (indicated by arrows 66) from the area 24 flows almost exclusively through the smaller upper flow ports 60, even though some fluid may pass between the sleeve 50 and cage 42 to flow through the larger lower flow ports 62. The fluid 66 may commingle in the fluid passage 26 with fluid 20 from another portion of the well, or, alternatively, if an injection operation is performed, the fluids may be oppositely directed and the fluid 66 would then represent a portion of the injected fluid which passes outwardly through the openings 46 from the fluid passage 26.

It is a particular benefit of the present invention that the fluids 20, 66 may be commingled within the fluid passage 26, and the rate of flow of each may be accurately regulated utilizing one or more of the chokes 10 as described hereinabove. For example, another choke, similar to the illustrated choke 10, may be installed below the choke 10 to regulate the rate of flow of the fluid 20, while the choke 10 regulates the rate of flow of the fluid 66. Alternatively, where the choke 10 is used in an injection operation, the choke may be utilized to regulate the rate of fluid flow outward through the flow ports 60, 62, and, alone or in combination with additional chokes, may be utilized to accurately regulate fluid flow rates into multiple zones in a well. Of course, the choke 10 may also be useful in single zone completions to regulate fluid flow into or out of the zone.

Figure 3:
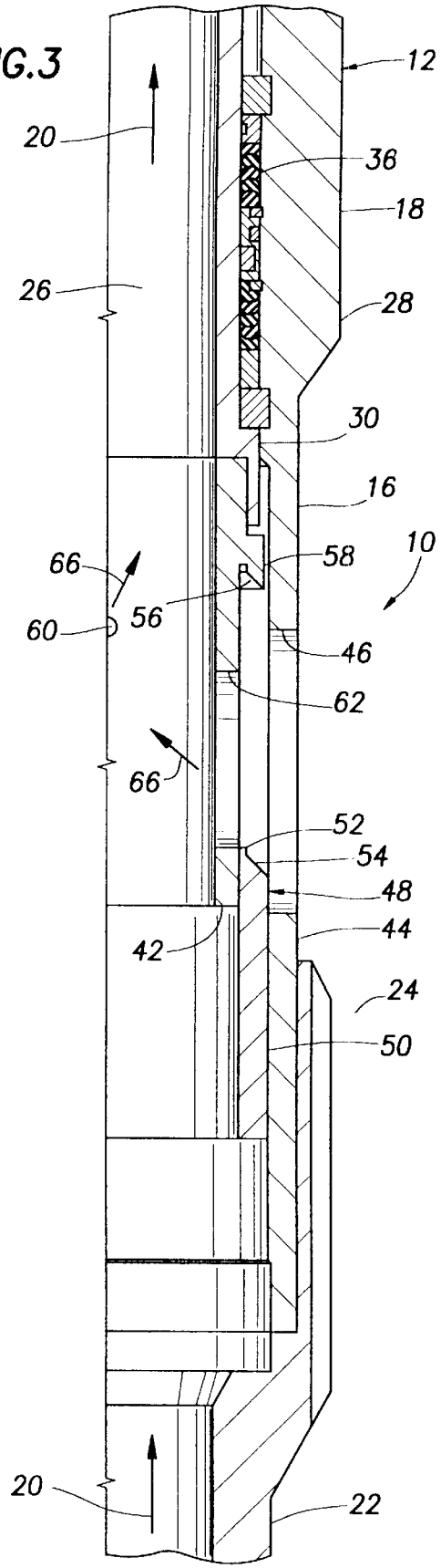
FIG. 3 is a quarter-sectional view of an axial portion of the choke of FIGS. 1A–1B, the choke being shown in a configuration in which the choke member set has been fully opened.

Referring additionally now to FIG. 3, an axial portion of the choke 10 is representatively illustrated in a fully open configuration in which the cage 42 is further axially upwardly displaced as compared to that shown in FIG. 2, completely uncovering both of the flow port sets 60, 62. The fluid 66 is, thus, permitted to flow unobstructed inwardly through the flow port sets 60, 62 and into the fluid passage 26. The cage 42 has been rotated ninety degrees about its longitudinal axis, so that it may be clearly seen that the ports 62 are now aligned with the openings 46. Therefore, upward displacement of the cage 42 both uncovers the ports 62 and aligns the ports with the openings 46 of the housing 44.

Preferably, the ports 62 are directly aligned with the openings 46 in the fully open configuration of the choke 10 and, furthermore, it is preferred that the ports 62 and openings 46 are similarly sized in order to minimize resistance to flow therethrough, reduce friction losses and minimize erosion of the choke 10. However, it is to be clearly understood that it is not necessary in keeping with the principles of the present invention for the ports 62 to be directly aligned with the openings 46, nor for the ports 62 to be identical in size, shape or number with the openings 46. If the ports 62 are not aligned with the openings 46 in the fully open configuration of the choke 10, then preferably a sufficiently large annular space is provided between the exterior of the cage 42 and the interior of the housing 44 so that fluid flow therebetween has minimum resistance.

Although FIG. 3 representatively illustrates the cage 42 rotated so that the ports 62 are directly aligned with the openings 46, it is to be clearly understood that such rotation is not necessary in operation of the choke 10. However, to achieve such direct alignment between the ports 62 and openings 46, the cage 42 and/or mandrel 30 may be rotationally secured to the housing 44 in a manner which prevents misalignment between the ports and openings. For example, a radially outwardly extending projection or key (not shown) may be provided on the cage 42 and/or mandrel 30 and cooperatively slidingly engaged with a groove or keyway (not shown) formed internally on the housing 44 and/or actuator 12, sleeve 50, etc., to thereby prevent relative circumferential displacement between the cage and housing.

It will be readily apparent to one of ordinary skill in the art that the relative proportions of the fluids 20, 66 produced through the tubing string 18 may be conveniently regulated by selectively permitting greater or smaller fluid flow rates through the choke member set 48. With fluid flow substantially restricted through the ports 60, 62 by the sleeve 50, the fluid produced through the tubing string 18 may have a greater proportion of the fluid 20. With fluid flow being unobstructed through the choke member set 48, the fluid produced through the tubing string 18 may have a greater proportion of the fluid 66.

Figure 4:
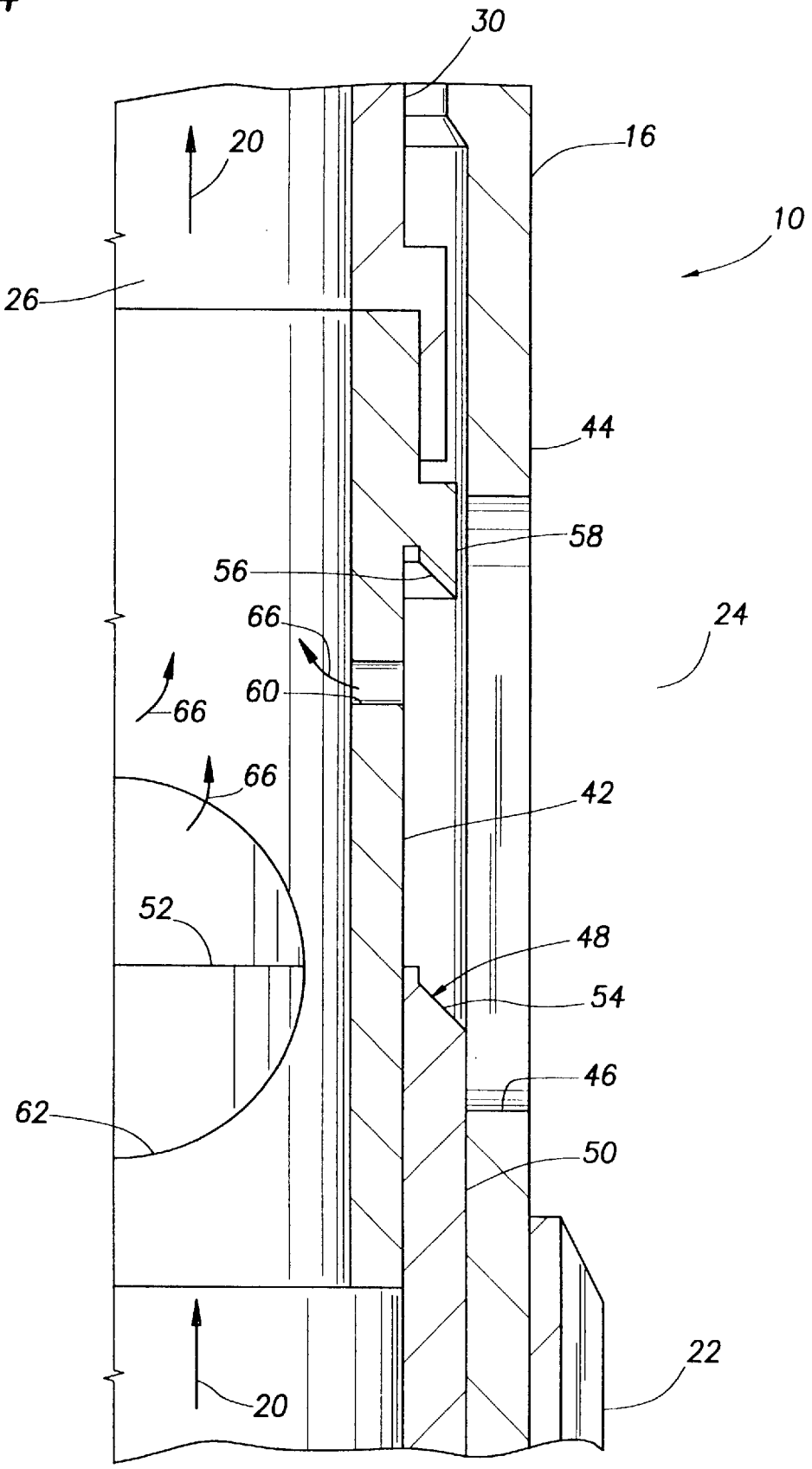
FIG. 4 is an enlarged quarter-sectional view of an axial portion of the choke of FIGS. 1A–1B, the choke being shown in a configuration in which fluid flow through a port of the choke member set is partially restricted.

Referring additionally now to FIG. 4, an enlarged axial portion of the choke 10 is representatively illustrated with the cage 42 in an intermediate position in which the lip 52 on the sleeve 50 is overlying the lower flow ports 62. Thus, fluid flow through the lower flow ports 62 is restricted by the sleeve 50, and fluid flow through the upper flow ports 60 is not restricted by the sleeve. It will be readily apparent to a person of ordinary skill in the art that fluid flow through the flow ports 62 may be variably choked or restricted by correspondingly variably displacing the flow ports 62 relative to the sleeve 50. In other words, if the cage 42 is displaced axially upward somewhat from its position as shown in FIG. 4, fluid flow through the flow ports 62 will be correspondingly less restricted, and if the cage is displaced axially downward somewhat, fluid flow through the flow ports will be correspondingly more restricted. It will also be readily apparent that there are an infinite number of positions of the cage 42 relative to the sleeve 50 in which fluid flow is permitted through the choke member set 48.

The lip 52 is disposed partially obstructing the flow ports 62. It is believed that the presence of the lip 52 extending outwardly from the sleeve 50 acts to reduce erosion of the sleeve, particularly the seal surface 54, and also aids in reducing erosion of the cage 42 adjacent the flow ports 60, 62 when the fluid 66 is flowing therethrough. The lip 52 deflects the fluid flow path away from the seal surface 54

Additionally, it is believed that the diametrically opposite orientation of the individual ports of each of the flow port sets 60, 62 acts to reduce erosion of the cage 42, in that inwardly directed fluid 66 flowing through one of two diametrically opposing ports will interfere with, or impinge on, the fluid flowing inwardly through the other port, thereby causing the fluid velocity to decrease and, accordingly, cause the fluid's kinetic energy to decrease. Thus, the impinging fluid flows in the center of the cage 42 dissipates the fluid energy onto itself and reduces erosion by containing turbulence and throttling wear within the cage. The sealing surfaces 54, 56 are isolated from the flow paths and sealing integrity is maintained, even though erosion may take place at the ports 60, 62.

Preferably, each of the flow port sets 60, 62 includes individual ports of equal diameter provided in pairs, as shown in the accompanying drawings, or greater numbers, as long as the geometry of the ports is arranged so that impingement results between fluid flowing through the ports, and so that such impingement occurs at or near the center of the cage 42 and away from the seal surfaces 54, 56, ports, and other flow controlling elements of the choke 10. As an example of alternate preferred arrangements of the flow port set 62, three ports of equal size and geometry could be provided, spaced around the circumference of the cage 42 at 120 degrees apart from each other, or four ports of equal size and geometry could be provided, spaced around the circumference of the cage at 90 degrees apart from each other, etc.

It is a particular benefit of the embodiment of the invention described herein that portions thereof may erode during normal use, without affecting the ability of the choke 10 to be closed to fluid flow therethrough. For example, the lip 52, the flow port sets 60, 62 and the interior of the cage 42, etc., may erode without damaging the seal surfaces 54, 56. Thus, where it is important for safety purposes to ensure the fluid tight sealing integrity of the wellbore, the choke 10 preserves its ability to shut off fluid flow therethrough even where its fluid choking elements have been degraded.

Thus has been described the choke 10 and methods of controlling fluid flow within the well using the choke, which provide reliability, ruggedness, longevity, and do not require complex mechanisms. Of course, modifications, substitutions, additions, deletions, etc., may be made to the exemplary embodiment described herein, which changes would be obvious to one of ordinary skill in the art, and such changes are contemplated by the principles of the present invention. For example, the operating mandrel 30 may be releasably attached to the actuator piston 14, so that, if the actuator 12 becomes inoperative, the cage 42 may be displaced independently from the piston. As another example, the cage 42 may be displaced circumferentially or radially, rather than axially, in order to selectively open choke member sets positioned radially about the cage, rather than being positioned axially relative to the cage. Accordingly, the foregoing detailed description is to be clearly understood as being given by way of illustration and example only, the spirit and scope of the present invention being limited solely by the appended claims.

Referring additionally now to FIGS. 5A–5C another choke 70 which embodies principles of the present invention is representatively illustrated. The choke 70 is sealingly attached to an actuator 72, a lower portion of which is shown in FIG. 1A. In a manner which will be more fully described hereinbelow, the actuator 72 is used to operate the choke 70. The actuator 72 may be hydraulically, electrically, mechanically, magnetically or otherwise controlled without departing from the principles of the present invention. The representatively illustrated actuator 72 is the SCRAMS ICV hydraulically controlled actuator referred to above. It includes an actuator member or annular piston 74 which is axially displaceable relative to the choke 70 by appropriate hydraulic pressure applied to the actuator 72 via control lines (not shown) extending to the earth's surface.

In a method of using the choke 70, the choke and actuator 72 are positioned within a subterranean well as part of a production tubing string 78 extending to the earth's surface. As representatively illustrated in FIGS. 5A–5C, fluid (indicated by arrows 80) may flow axially through the choke 70 and actuator 72, and to the earth's surface via the tubing string 78. The fluid 80 may, for example, be produced from a zone of the well below the choke 70. In that case, an additional portion of the tubing string 78 including a packer (not shown) may be attached in a conventional manner to a lower adaptor 82 of the choke 70 and set in the well in order to isolate the zone below the choke from other zones of the well, such as a zone in fluid communication with an area 84 surrounding the choke.

In a manner similar to that described hereinabove for the choke 10, the choke 70 enables accurate regulation of fluid flow between the external area 84 and an internal axial fluid passage 86 extending through the choke. In another method of using the choke 70, multiple chokes may be installed in the tubing string 18, with each of the chokes corresponding to a respective one of multiple zones intersected by the well, and with the zones being isolated from each other external to the tubing string. Thus, the choke 70 also enables accurate regulation of a rate of fluid flow from each of the multiple zones, with the fluids being commingled in the tubing string 78.

It is to be understood that, although the tubing string 78 is representatively illustrated in the accompanying drawings with fluid 80 entering the lower adaptor 82 and flowing upwardly through the fluid passage 86, the lower adaptor 82 may actually be closed off or otherwise isolated from such fluid flow in a conventional manner, such as by attaching a bull plug thereto, or the fluid 80 may be flowed downwardly through the fluid passage 86, for example, in order to inject the fluid into a formation intersected by the well, without departing from the principles of the present invention. For convenience and clarity of description, the choke 70 and associated tubing string 78 will be described hereinbelow as it may be used in a method of producing fluids from multiple zones of the well, the fluids being commingled within the tubing string, and it being expressly understood that the choke 70 may be used in other methods without departing from the principles of the present invention.

An upper portion 76 of the choke 70 is attached to the actuator 72. The upper portion 76 may be integrally formed with an outer housing 88 of the actuator 72. Alternatively, the choke 70 may be threadedly attached to the actuator 72, or otherwise attached thereto without departing from the principles of the present invention. In that manner, the choke 70 may be used with other actuators, attached directly to the remainder of the tubing string 78, etc.

The piston 74 is attached externally about an upper generally tubular operating mandrel 90 of the choke 70. The piston 74 is retained axially between a radially enlarged external shoulder 92 formed on the mandrel 90 and a ring 94 secured with respect to a circumferential groove 96 externally formed on the mandrel. In substantial part, axial displacement of the piston 74 by the actuator 72 will cause a corresponding axial displacement of the mandrel 90. However, in a manner that will be more fully described below, a portion of axial displacement of the piston 74 may be utilized in selectively locking or unlocking the mandrel 90 in its position with respect to the remainder of the choke 70.

The piston 74 is slidingly and sealingly engaged with the exterior surface of the mandrel 90 and with the interior surface of the housing 88 of the actuator 72. In this manner, the piston 74 provides fluid isolation between two chambers 98, 100 formed radially between the housing 88 and the mandrel 90. It may be considered that the mandrel 90 becomes a part of the actuator 72, since the mandrel in part encloses the chambers 98, 100 and sealingly engages the piston 74, but it is to be clearly understood that it is not necessary, in keeping with the principles of the present invention, for the mandrel 90 to form a part of the actuator 72.

Axial displacement of the mandrel 90 is accomplished by applying fluid pressure to one of the chambers 98, 100 to thereby apply an axially directed biasing force to the piston 74 and, thus, to the mandrel. For example, if it is desired to displace the mandrel 90 axially upward to permit fluid flow through the choke 70 or to decrease resistance to fluid flow therethrough, fluid pressure may be applied to the lower chamber 100. Conversely, if it is desired to downwardly displace the mandrel 90 to prevent fluid flow through the choke 70 or to increase resistance to fluid flow therethrough, fluid pressure may be applied to the upper chamber 98.

To operate the choke 70, the mandrel 90 is axially displaced relative to the upper portion 76, in order to axially displace an inner axially extending and generally tubular cage member 102 relative to an outer housing 104 of the choke. The mandrel 90 is interconnected to the cage 102 in a manner that permits a biasing force to be applied to the cage without the need of applying or maintaining fluid pressure in either of the actuator's fluid chambers 98, 100. Such interconnection will be more fully described below.

The housing 104 includes a series of axially elongated and circumferentially spaced apart openings 106, only one of which is visible in FIG. 1B. The openings 106 are formed through a sidewall portion of the housing 104 and thereby provide fluid communication between the area 84 external to the choke 70 and the interior of the housing. The housing 104 is integrally formed with the upper portion 76 and the lower adaptor 82, with the openings 106 being positioned axially between the upper portion and the lower adaptor.

A choke member set 108 is disposed within the outer housing 104 and includes a portion of a sleeve 110 received sealingly within the outer housing. As used herein, the term "choke member set" is used to describe an element or combination of elements which perform a function of regulating fluid flow. In the illustrated embodiment of the invention, the choke member set 108 includes an upper portion of the sleeve 110 and portions of the cage 102, which will be more fully described hereinbelow. The applicants prefer that the choke member set 108 be configured in some respects similar to those utilized in the Master Flo Flow Trim referred to above, although other choke member sets may be utilized without departing from the principles of the present invention.

The sleeve 110 is preferably manufactured of an erosion resistant material, such as carbide, and is sealingly received in the housing 104 by shrink fitting it therein. Of course, other methods of sealingly attaching the sleeve 110 may be utilized without departing from the principles of the present invention. For example, the sleeve 110 could be threaded into the housing 104, brazed therein, etc.

The sleeve 110 includes an axially extending and internally inclined lip 112 adjacent an externally inclined seal surface 114. The lip 112 acts to prevent, or at least greatly reduce, erosion of the seal surface 114, among other benefits. The seal surface 114 is cooperatively shaped to sealingly engage a seal surface 116 internally formed on a seat 118, which is externally carried on the cage 102 and integrally formed therewith. In the configuration of the choke 70 shown in FIG. 5B, the seal surface 114 is contacting and sealingly engaging the seal surface 116. Preferably, the seal surfaces 114, 116 are formed of hardened metal or carbide for erosion resistance, although other materials, such as resilient materials, may be utilized without departing from the principles of the present invention. Additionally, the seat 118, which includes the seal surface 116, may be wholly or partially formed of hardened metal or carbide, and may be separately formed from the cage 102 and sealingly attached thereto, etc.

The cage 102 has a set of comparatively small flow ports 120, and a set of comparatively larger flow ports 122, formed radially therethrough. The set of ports 120 includes two circumferentially spaced apart and oppositely disposed ports, although only one is visible in FIG. 5C, and the set of ports 122 includes four equally circumferentially spaced apart ports, although only two are visible in FIG. 9C. Of course, other numbers of ports may be utilized in the flow port sets 120, 122 without departing from the principles of the present invention. In the configuration of the choke 70 shown in FIG. 5C, the upper ports 120 and lower ports 122 are radially outwardly overlaid by the sleeve 110, and the seal surfaces 114, 116 are sealingly engaged. Thus, fluid communication between the external area 84 and the flow passage 86 through the flow ports 120, 122 is prevented by the sleeve 110.

As representatively illustrated in the accompanying drawings, the flow ports 120 are comparatively small, in order to provide an initial relatively highly restricted fluid flow therethrough when the cage 102 is displaced axially upward to permit fluid flow between the seal surfaces 114, 116, as more fully described hereinbelow. However, it is to be understood that the flow ports 120, 122 may be otherwise dimensioned, otherwise shaped (e.g., elliptical, oval, square, oblong, etc.), otherwise positioned, otherwise dimensioned with respect to each other, and otherwise positioned with respect to each other, without departing from the principles of the present invention. For example, the upper flow ports 120 may actually have larger or smaller dimensions, may have larger or smaller dimensions than the lower flow ports 122, may be positioned differently on the cage 102, and may be positioned differently with respect to the lower flow ports. Similar changes may be made to the lower flow ports 122. Indeed, it is not necessary for the cage 102 to have differently configured sets of flow ports 120, 122 at all. Thus, the flow port sets 120, 122 shown in the accompanying drawings are merely illustrative and additions, modifications, deletions, substitutions, etc., for example, by making one or more of the ports oval, elliptical, triangular, or otherwise shaped, may be made thereto without departing from the principles of the present invention.

As shown in FIGS. 5A–5C, the cage 102 is prevented from displacing axially downward relative to the sleeve 110 by axial contact between the seal surfaces 114, 116. Such axial contact may be maintained by maintaining fluid pressure in the chamber 98 of the actuator 72. It will be readily apparent to a person of ordinary skill in the art that such axial contact may also be maintained by provision of a biasing device 128, which applies an axially downward biasing force to the cage 102. Operation of the biasing device 128 in maintaining axial contact between the seal surfaces 114, 116 will be more fully described hereinbelow.

For displacement of the mandrel 90 and cage 102 in the event of a failure of the actuator 72, conventional shifting profiles 124 are internally formed on the mandrel 90 and a mandrel extension 130 threadedly attached to a lower end of the mandrel. Either of the shifting profiles 124 may be engaged by a shifting tool (not shown) conveyed on wireline, slickline, coiled tubing, etc., in a conventional manner. Of course, other profiles and methods of displacing the mandrel 90 and/or cage 102 may be utilized without departing from the principles of the present invention. Additionally, other methods of maintaining the cage 102 in a desired position relative to the housing 1(Y4 and/or sleeve 110 may be utilized without departing from the principles of the present invention. For example, detents, etc., may be configured to cooperatively engage the cage 102 and/or housing 104. For this purpose, a locking mechanism 132 is provided in the choke 70, and will be more fully described below.

If the cage 102 is displaced axially upward relative to the sleeve 110 and housing 104, the seal surfaces 114, 116 will disengage and fluid flow will be permitted between the external area 84 and the fluid passage 86. Thus, the choke member set 108 is selectively openable by axially displacing the cage 102 upward from its position shown in FIG. 5C. The choke member set 108 may be maintained in an open position by, for example, a latching device (not shown). A suitable latching device is shown and described in the copending application having an attorney docket no. of 970331 U1 USA.

It will be readily apparent to a person of ordinary skill in the art that, with suitable modification, e.g., interchanging the cage 102 and sleeve 110, the sleeve may instead be displaced relative to the cage, to permit fluid communication between the area 84 and the fluid passage 86. Alternatively, both the cage 102 and sleeve 110 could be displaced relative to the housing 104 and to each other. No matter the manner in which relative displacement occurs between the cage 102 and sleeve 110, such relative displacement permits variable choking of fluid flow through the flow ports 120, 122 and sealing engagement between the seal surfaces 114, 116 when desired in a manner similar to that described above for the choke 10.

Preferably, the ports 120,122 are directly aligned with the openings 106 in the fully open configuration of the choke 70 and, furthermore, it is preferred that the combined ports 120,122 and openings 106 are similarly sized in order to minimize resistance to flow therethrough, reduce friction losses and minimize erosion of the choke 70. Referring additionally now to FIG. 6, an elevational view of one of the openings 106 is representatively illustrated. The opening 106 shown in FIG. 6 has a generally axially extending upper portion 134 and a generally circular shaped lower portion 136. When the choke member set 108 is in its fully open position, the comparatively small flow ports 120 are positioned radially opposite the comparatively small upper portions 134 of the openings 106, and the comparatively large flow ports 122 are positioned radially opposite the comparatively large lower portions 136 of the openings. In this manner, the openings 106 are conformed in relation to the dimensions and orientations of the flow port sets 120, 122 to aid in minimizing erosion of various elements of the choke 70.

However, it is to be clearly understood that it is not necessary in keeping with the principles of the present invention for the ports 120, 122 to be directly aligned with the openings 106, nor for the ports 120, 122 to be identical in size, shape or number with the openings 106. If the ports 120, 122 are not aligned with the openings 106 in the fully open configuration of the choke 70, then preferably a sufficiently large annular space is provided between the exterior of the cage 102 and the interior of the housing 104 so that fluid flow therebetween has minimum resistance.

In order to achieve such alignment between the ports 120, 122 and openings 106 in the representatively illustrated choke 70, the cage 102 is rotationally secured to the housing 104 in a manner which prevents misalignment between the ports and openings. Specifically, an alignment key 138 extends radially through, and is fastened to, the outer housing 104 and axially slidingly engages a slotted recess 140 formed externally on a generally tubular cage extension 142 attached to the cage 102 and extending axially upward therefrom. The cage extension 142 is sealingly attached to the cage 102 by shrink fitting it thereto, although any other suitable connection method, such as brazing, threading, integrally forming, etc., may be utilized without departing from the principles of the present invention. The applicants use shrink fitting since, in the representatively illustrated embodiment of the invention, the cage 102 is made of a highly erosion resistant material, such as carbide, while the cage extension 142 is made of an alloy steel, although other materials may be used. Thus, engagement of the key 138 with the slotted recess 140 prevents circumferential displacement of the cage 102 relative to the housing 104, but permits axial displacement of the cage relative to the housing.

The cage 102 is attached to the mandrel 90 in a manner that permits the biasing device 128 to exert a biasing force on the cage, so that the sealing surfaces 114, 116 remain sealingly engaged when the choke member set 108 is in its closed position as shown in FIG. 5C The biasing device 128 is representatively illustrated as a stack of belleville springs, although other biasing devices, such as coil springs, resilient members, etc., may be utilized without departing from the principles of the present invention. The biasing device 128 is axially retained between an upper ring 144 and a lower ring 146, which are slidingly disposed on a radially reduced lower portion 148 formed externally on the mandrel 90. The lower ring 146 is threadedly attached to the cage extension 142. Thus, axially downward displacement of the mandrel 90 after the sealing surfaces 114, 116 have contacted, will cause the biasing device 128 to be compressed axially between the rings 144, 146, and will apply a downwardly directed biasing force to the cage 102 via the cage extension 142.

A seal or packing stack 150 provides sealing engagement radially between the mandrel 90 and the cage extension 142, while permitting relative axial displacement therebetween. The seal 150 is axially retained between an expandable ring 152 installed in an annular groove formed on the radially reduced portion 148, and the mandrel extension 124.

The locking mechanism 132 permits the mandrel 90 to be releasably secured in its axial position relative to the housing 104, after the mandrel has been axially downwardly displaced so that the sealing surfaces 114, 116 contact, and after the mandrel has been further downwardly displaced so that the biasing device 128 exerts a downwardly biasing force on the cage 102 as described above and shown in FIG. 5C. In this manner, the biasing force will be maintained, even though fluid pressure in the upper chamber 98 of the actuator 72 may be intentionally relieved or accidentally lost.

The locking mechanism 132 includes a radially expandable ring 154, which is radially outwardly retained by a radially reduced lower portion 156 formed on the piston 74. The piston 74 is biased downwardly, so that the lower portion 156 radially outwardly extends the ring 154, by a biasing device 158, which is representatively illustrated as a stack of belleville springs. The biasing device 158 is axially retained between the ring 94 and the piston 74.

When radially outwardly extended as shown in FIG. 5B, the ring 154 engages a radially enlarged groove 160 formed internally on the actuator housing 88 and abuts the shoulder 92 on the mandrel 90. Such engagement between the ring 154 and the groove 160 prevents axially upward displacement of the mandrel 90 relative to the housing 104. Thus, with the mandrel 90 in its position as shown in FIGS. 5A–5C, the biasing device 128 is biasing the sealing surfaces 114,116 toward sealing engagement with each other, the biasing device 158 is biasing the piston 74 to extend the ring 154 into engagement with the groove 160, and the mandrel 90 is prevented from displacing axially upward.

To radially inwardly retract the ring 154 and thereby disengage the ring from the groove 160, fluid pressure may be applied to the lower chamber 100, which is in fluid communication with the piston 74, and which will bias the piston upwardly against the biasing force exerted by the biasing device 158. When sufficient fluid pressure has been applied to the chamber 100 to overcome the biasing force exerted by the biasing device 158, the piston 74 will displace upwardly, thereby permitting the ring 154 to radially inwardly retract out of engagement with the groove 160. Such fluid pressure will also bias the mandrel 90 upwardly, causing the mandrel to displace upwardly, eventually removing the biasing force exerted by the biasing device 128 from the cage 102.

When it is again desired to lock the mandrel 90 in its position relative to the housing 104, fluid pressure may be relieved from the lower chamber 100 and applied to the upper chamber 98 to thereby bias the mandrel downwardly. When the ring 154 is radially opposite the groove 160, the biasing force exerted by the biasing device 158, in addition to the biasing force resulting from any fluid pressure in the upper chamber 98, will cause the lower portion 156 of the piston to radially outwardly extend the ring into engagement with the groove 160. Of course, it will be readily apparent to one of ordinary skill in the art that the biasing device 158 continually exerts a downwardly biasing force on the piston 74, while fluid pressures in the chambers 98, 100 only exert biasing forces on the piston when those fluid pressures are applied to the chambers. Thus, an operator may apply fluid pressure to the upper chamber 98 to close the choke member set 108 and to apply a biasing force to the choke member set so that the sealing surfaces 114, 116 remain sealingly engaged, and then relieve the fluid pressure from the upper chamber while the mandrel remains locked in its position relative to the housing. Thereafter, when it is desired to open the choke member set 108, the operator may apply fluid pressure to the lower chamber 100 to permit relative displacement between the mandrel 90 and the housing 104.

Thus has been described the choke 70 and methods of controlling fluid flow within the well using the choke, which provide reliability, ruggedness, longevity, and do not require complex mechanisms. Of course, modifications, substitutions, additions, deletions, etc., may be made to the exemplary embodiment described herein, which changes would be obvious to one of ordinary skill in the art, and such changes are contemplated by the principles of the present invention. For example, the operating mandrel 90 may be releasably attached to the actuator piston 74, so that, if the actuator 72 becomes inoperative, the cage 102 may be displaced independently from the piston. As another example, the cage 102 may be displaced circumferentially or radially, rather than axially, in order to selectively open choke member sets positioned radially about the cage, rather than being positioned axially relative to the cage. As a further example, a series of lugs, keys or collets may be utilized in place of the expandable ring 154 in the locking mechanism 132. Accordingly, the foregoing detailed description is to be clearly understood as being given by way of illustration and example only, the spirit and scope of the present invention being limited solely by the appended claims.

What is claimed is:

1. A flow control apparatus operatively positionable within a subterranean well, the apparatus comprising:

a first member; and a second member having a port for flow of fluid, fluid flow through the port being regulatable by displacement of the first member relative to the second member.

2. The flow control apparatus according to claim 1, wherein the first and second members are sealingly engageable to prevent fluid flow through the port.

3. The flow control apparatus according to claim 2, further comprising a biasing device, the biasing device applying a biasing force to one of the first and second members to thereby maintain sealing engagement of the one of the first and second members with the other of the first and second members.

4. The flow control apparatus according to claim 1, further comprising a locking mechanism, the locking mechanism selectively preventing displacement of the first member relative to the second member.

5. The flow control apparatus according to claim 4, wherein the locking mechanism is configured to selectively permit displacement of the first member relative to the second member upon application of fluid pressure to the locking mechanism.

6. The flow control apparatus according to claim 4, wherein the first member is sealingly engageable with the second member, and wherein the locking mechanism is configured to releasably prevent displacement of the first member relative to the second member when the first member is sealingly engaged with the second member.

7. The flow control apparatus according to claim 1, further comprising a generally tubular outer housing, the first and second members being disposed at least partially within the outer housing, and the outer housing being configured for cooperative attachment to a tubing string positioned within the subterranean well.

8. A choke operatively positionable within a subterranean well, the choke comprising:

a generally tubular first member;

a generally tubular second member slidingly disposed relative to the first member, the second member having at least one flow port formed through a sidewall portion thereof, and the second member further being variably positionable relative to the first member to variably regulate fluid flow through the flow port.

9. The choke according to claim 8, wherein the first member is sealingly engageable with the second member to prevent fluid flow through the flow port.

10. The choke according to claim 8, wherein the second member is secured to a mandrel, the mandrel being displaceable relative to the first member to thereby displace the second member relative to the first member.

11. The choke according to claim 10, wherein the mandrel is rotatably secured to the second member.

12. The choke according to claim 10, wherein the mandrel is configured for displacement relative to the first member by application of fluid pressure thereto.

13. The choke according to claim 10, wherein the mandrel has a shifting profile formed thereon, and wherein the profile is configured for engagement with a shifting tool.

14. The choke according to claim 8, further comprising a biasing device, the biasing device being configured to bias the second member toward sealing engagement with the first member.

15. The choke according to claim 8, wherein the second member is selectively and releasably securable relative to the first member.

16. The choke according to claim 15, wherein the second member is securable relative to the first member when the second member sealingly engages the first member to prevent fluid flow through the flow port.

17. The choke according to claim 8, wherein the first member is a sleeve, and wherein the second member is a cage.

18. Apparatus operatively positionable within a subterranean well, the apparatus comprising:

a generally tubular member having a flow passage extending generally axially therethrough, and the member further having a first port formed through a sidewall portion thereof; and a sleeve slidingly disposed relative to the member, the member being positionable relative to the sleeve in a selected one of a first position in which the sleeve prevents fluid flow through the first port, a second position in which unobstructed fluid flow is permitted through the first port, and a third position in which fluid flow through the first port is partially obstructed by the sleeve.

19. The apparatus according to claim 18, wherein the sleeve has a lip extending outwardly therefrom, the lip being disposed generally radially opposite the first port when the member is in the third position.

20. The apparatus according to claim 19, wherein the lip is configured to inhibit erosion of the sleeve when the member is in the third position.

21. The apparatus according to claim 19, wherein the lip is configured to inhibit erosion of the tubular member when the member is in the third position.

22. The apparatus according to claim 18, further comprising a first seal surface carried on the member, and a second seal surface formed on the sleeve, the first and second seal surfaces being sealingly engaged when the member is in the first position.

23. The apparatus according to claim 18, further comprising a generally tubular outer housing, the member and sleeve being disposed at least partially within the housing.

24. The apparatus according to claim 23, wherein the sleeve is coaxially attached within the housing.

25. The apparatus according to claim 24, wherein an end portion of the sleeve has a lip extending outwardly therefrom, and wherein the lip is positioned radially inward relative to an opening formed through a sidewall portion of the housing.

26. The apparatus according to claim 18, wherein the member further has a second port formed through the member sidewall portion, the first and second ports being axially spaced apart.

27. The apparatus according to claim 26, wherein in the first, second and third positions of the member, fluid flow is permitted through the second port.

28. The apparatus according to claim 27, wherein the member further has fourth and fifth positions relative to the sleeve, fluid flow being permitted through the second port when the member is in the fourth position, and fluid flow through the second port being prevented when the member is in the fifth position.

29. The apparatus according to claim 26, wherein the second port has a flow area unequal to a flow area of the first port.

30. The apparatus according to claim 18, wherein the tubular member further has a second port formed through the sidewall portion thereof, and wherein the second port is positioned opposite the first port, whereby when fluid flows inwardly through each of the first and second ports, the fluid flows interfere with each other and inhibit erosion of the tubular member.

31. The apparatus according to claim 18, wherein the member is further positionable in an infinite number of positions between the first and second positions.

32. The apparatus according to claim 18, wherein the sleeve is radially outwardly disposed about the member.

33. The apparatus according to claim 32, further comprising a generally tubular seat carried externally on the member, the seat sealingly engaging the sleeve when the member is in the first position.

34. A choke operatively positionable within a subterranean well and operatively connectable to an actuator disposed within the well, the actuator having an actuator member which is displaceable relative to the remainder of the actuator in a selected one of first and second opposite directions, the choke comprising:

a first member interconnectable to the actuator member and displaceable therewith;

a seal surface carried on the first member; and a second member slidingly disposed relative to the first member, the first member being displaceable in the first direction by the actuator member to sealingly engage the second member with the seal surface to thereby prevent fluid flow through a sidewall portion of the first member, and the first member being displaceable in the second direction by the actuator member to thereby permit fluid flow through the sidewall portion of the first member.

35. The choke according to claim 34, wherein the second member is a sleeve externally disposed about the first member.

36. The choke according to claim 34, further comprising a port formed through the sidewall portion, the port being positionable between the seal surface and the second member when the first member is displaced in the second direction.

37. The choke according to claim 36, wherein the first member is variably positionable relative to the second member so that fluid flow through the port is correspondingly variably restricted.

38. The choke according to claim 36, wherein the sleeve has a flow deflection lip formed thereon, and wherein the lip is positionable in an overlying relationship to the port.

39. A choke operatively positionable within a subterranean well, the choke comprising:

a generally tubular inner cage having a port formed through a sidewall portion thereof;

a seat carried externally on the cage spaced apart from the port; and a sleeve externally slidingly disposed on the cage.

40. The choke according to claim 39, wherein the sleeve has opposite ends, one of the sleeve opposite ends being configured for sealing engagement with the seat.

41. The choke according to claim 40, wherein the other of the sleeve opposite ends is sealingly received within an outer housing.

42. The choke according to claim 41, wherein the sleeve is rigidly attached to the housing, the one of the sleeve opposite ends being positioned radially opposite an opening formed through a sidewall portion of the housing.

43. The choke according to claim 39, wherein the seat and sidewall portion of the cage are formed of a material having an erosion resistance greater than that of the remainder of the cage.

44. A method of controlling fluid flow into a tubing string disposed within a subterranean well, the method comprising the steps of:

attaching an actuator to the tubing string;

operatively attaching a choke to the actuator, the choke being capable of regulating fluid flow through a sidewall portion thereof, the choke including a choke member set; and actuating the actuator to variably open the choke member set and thereby variably choke fluid flow therethrough.

45. The method according to claim 44, wherein the step of actuating the actuator to open the choke member set further comprises displacing a first tubular member relative to a second tubular member.

46. The method according to claim 45, wherein the first tubular member displacing step comprises displacing a seat portion of the choke member set out of sealing engagement with a sleeve portion of the choke member set.

47. The method according to claim 46, wherein the first tubular member displacing step further comprises displacing a port formed through the first tubular member relative to the choke member set sleeve portion.

48. The method according to claim 47, wherein the port displacing step comprises displacing the port from a first position in which the port is radially inwardly disposed relative to the sleeve portion, to a second position in which the port is at least partially open to fluid flow therethrough.

49. The method according to claim 47, wherein the port displacing step comprises displacing the port from a first position in which fluid flow through the port is prevented by sealing engagement of the sleeve portion with the seat portion, to a second position in which fluid flow through the port is partially obstructed by the sleeve portion.

50. A method of controlling fluid flow within a subterranean well, comprising the steps of:

providing an actuator having an actuator member which is displaceable relative to the remainder of the actuator in a selected one of first and second opposite directions;

providing a choke including a first member interconnectable to the actuator member and displaceable therewith, a seal surface carried on the first member, and a second member slidingly disposed relative to the first member, the first member displacing relative to the second member and thereby permitting a progressively greater rate of fluid flow through a sidewall portion of the first member when the actuator member is displaced in the first direction, and the first member displacing relative to the second member and thereby increasingly restricting fluid flow through the sidewall portion when the actuator member is displaced in the second direction;

operatively interconnecting the actuator to the choke; and positioning the actuator and choke within the well.

51. The method according to claim 50, further comprising the step of displacing the actuator member in the second direction to sealingly engage the second member and the seal surface and thereby prevent fluid flow through the sidewall portion.

52. The method according to claim 50, wherein the choke is provided further including first and second ports formed through the sidewall portion.

53. The method according to claim 52, wherein the choke is provided with the first port having a restriction to fluid flow therethrough which is not equal to a restriction to fluid flow through the second port.

54. The method according to claim 50, further comprising the step of displacing the actuator member in the first direction, thereby telescopingly extending the first member from within the second member.

55. A method of controlling fluid flow within a subterranean well, comprising the steps of:

providing a tubular member having a plurality of spaced apart ports formed therethrough;

providing a blocking member for blocking fluid flow through the plurality of ports;

positioning the tubular member and blocking member within the well; and displacing the tubular member relative to the blocking member to thereby permit fluid flow through the plurality of ports.

56. The method according to claim 55, further comprising the step of providing a housing, the blocking member being disposed within, and attached to, the housing, and wherein the step of displacing the tubular member further comprises displacing the tubular member relative to the housing to thereby permit fluid flow through a sidewall portion of the housing.

57. The method according to claim 55, wherein the tubular member displacing step further comprises selecting a first one of the ports for fluid flow therethrough by displacing the tubular member in a first selected direction.

58. The method according to claim 57, wherein the tubular member displacing step further comprises selecting a second one of the ports for fluid flow therethrough, in addition to the first one of the ports, by further displacing the tubular member in the first selected direction.

* * * * *